US006260788B1

(12) United States Patent
Hultcrantz et al.

(10) Patent No.: US 6,260,788 B1
(45) Date of Patent: Jul. 17, 2001

(54) REEL-UP AND ASSOCIATED METHOD

(75) Inventors: Lars-Magnus Hultcrantz, Deje; Roland Karlsson, Karlstad, both of (SE)

(73) Assignee: Valmet-Karlstad AB, Karlstad (SE)

( * ) Notice: Subject to any disclaimer, the term of this patent is extended or adjusted under 35 U.S.C. 154(b) by 0 days.

(21) Appl. No.: 09/412,205

(22) Filed: Oct. 5, 1999

Related U.S. Application Data

(60) Provisional application No. 60/106,136, filed on Oct. 29, 1998.

(30) Foreign Application Priority Data

Oct. 5, 1998 (SE) ..... 9803355

(51) Int. Cl.[7] ..... B65H 19/22; B65H 19/30
(52) U.S. Cl. ..... 242/533.2; 242/542.3
(58) Field of Search ..... 242/533.2, 533, 242/533.1, 542.3

(56) References Cited

U.S. PATENT DOCUMENTS

| | | | | |
|---|---|---|---|---|
| 3,202,374 | | 8/1965 | Phelps . | |
| 3,586,253 | * | 6/1971 | Gilbank et al. | 242/533.1 |
| 3,633,840 | * | 1/1972 | Clark | 242/542.3 X |
| 3,877,654 | | 4/1975 | Randpalu et al. . | |
| 4,196,865 | * | 4/1980 | Patriksson | 242/533.1 X |
| 4,390,138 | | 6/1983 | Rohde et al. . | |
| 4,768,730 | * | 9/1988 | Laine | 242/533.2 |
| 4,778,122 | * | 10/1988 | Snygg | 242/533.1 |
| 4,905,925 | * | 3/1990 | Kremar | 242/533.1 |
| 5,184,787 | | 2/1993 | Holzinger et al. . | |
| 5,251,835 | * | 10/1993 | Kyytsonen | 242/533.2 |
| 5,520,354 | | 5/1996 | Adamski . | |
| 5,551,827 | * | 9/1996 | Menegatto | 242/533.2 X |
| 5,620,151 | | 4/1997 | Ueyama et al. . | |
| 5,673,870 | * | 10/1997 | Fielding et al. | 242/542.3 |
| 6,016,987 | * | 1/2000 | Kohnen | 242/533.2 |

* cited by examiner

*Primary Examiner*—William A. Rivera
(74) *Attorney, Agent, or Firm*—Alston & Bird LLP

(57) ABSTRACT

A reel-up in a paper machine has two primary arms, each of which has an elongate beam that is pivotably journalled on stand members in the reel-up, and a carriage that is displaceably journalled on the beam and has a gripper on its side that faces the surface winding drum for gripping a reeling drum collected from a top drum stock. Each beam has a free end located at a lesser distance from the pivot axis of the primary arm than the distance between the pivot axis and the empty reeling drum located in the drum stock. Each carriage can be displaced outwards from the beam so that the gripper is beyond the free end of the beam at a distance from the free end so as to assume a position for receipt of a reeling drum. One of the carriages carries a central drive device with a coupling device for axial movement into operating engagement with a coupling device on one end of the reeling drum, so as to rotate the reeling drum and bring its peripheral speed up to the speed of the traveling paper web while the primary arms are lowering the reeling drum to engage it with the surface winding drum of the reel-up.

20 Claims, 4 Drawing Sheets

REEL-UP AND ASSOCIATED METHOD

CROSS-REFERENCE TO RELATED APPLICATION

The present application claims the benefit of the filing date of U.S. Provisional Application Serial No. 60/106,136 filed Oct. 29, 1998.

FIELD OF THE INVENTION

The present invention relates to devices and methods for reeling a traveling web of paper or the like onto a reeling drum. The invention relates more particularly to such devices and methods wherein an empty reeling drum is retrieved by a pair of primary arms from a supply of empty reeling drums located vertically above a surface winding drum that carries the traveling web, and is lowered by the primary arms into a position engaging the winding drum such that the web begins to be wound onto the reeling drum.

BACKGROUND OF THE INVENTION

For reeling a continuous paper web, it is common to use a reel-up in which the paper web is reeled onto reeling drums to make finished paper reels. A traditional reel-up normally has a stand that comprises two longitudinally extending, parallel stand members, between which a powered surface winding drum is rotatably arranged. The surface winding drum is operated at a peripheral speed corresponding to the speed of travel of the paper web running over the surface winding drum. To maintain continuous production of paper reels, two separate reeling systems that cooperate with each other are normally used. These consist of a primary system, in which a number, usually a small number, of turns of the paper web is first wound onto an empty reeling drum, and a secondary system that receives the commenced paper reel from the primary system. The reeling of the paper web onto the reel is then continued in the secondary system to produce a finished paper reel. The primary system normally has a pair of pivotable primary arms arranged at either end of the surface winding drum. The described type of reel-up typically also has a pair of lowering arms pivotably journalled to a drum stock arranged above the surface winding drum. When the paper reel being reeled in the secondary system has reached a certain predetermined size, an empty reeling drum is lowered with the aid of the lowering arms from the drum stock to the primary arms. The secondary system, which is located downstream of the surface winding drum, comprises either a pair of secondary carriages each arranged to be linearly moveable along a stand member, or a pair of secondary arms each pivotable about a bearing. Each secondary carriage or secondary arm has a gripper for receipt of the reeling drum from the primary arms and for support of the same during reeling. The construction of the reel-up described here precludes a relatively large space above and nearby the surface winding drum from being used for any other installations, because of the necessary pivoting movements of the lowering arms. A reduction in the space required by the lowering arms would mean that the dimensions of the reel-up could be reduced in an advantageous way or, alternatively, that the space could be used for other important installations.

As reel-ups become ever faster, it also becomes increasingly important that a new reeling drum can be transferred from the drum stock into contact with the surface winding drum in a quick but nevertheless completely safe and reliable way. Endeavors have been made with some known reel-ups to increase safety by letting the primary arms themselves grip the reeling drum in the drum stock directly and then hold the reeling drum during the subsequent transfer down to the surface winding drum, thereby eliminating the lowering arms and the necessity of making a transfer from lowering arms to the primary arms. The time required for the transfer of an empty reeling drum represents a time during which optimal production of reeled-up paper cannot be obtained, which constitutes a problem to which no satisfactory solution has been found. This is especially true when it is considered that the reeling drum, before it can be brought into contact with the surface winding drum, must first be accelerated from stand-still up to the peripheral speed of the surface winding drum. A separate starting device arranged at the side of the surface winding drum is usually used for this acceleration. It would thus constitute a very substantial advantage if the acceleration of the reeling drum could be started and completed during the actual transfer of a new reeling drum from a drum stock, as production would then increase. Several known reel-ups have so far been constructed to at least endeavor to reduce one or more of the above-mentioned problems. No reel-up has yet managed to solve all the described problems in a satisfactory way.

For instance, EP-Al-350 212 discloses a reel-up with a primary system that comprises two pivotably arranged primary arms, which themselves collect each new reeling drum from a drum stock arranged above the surface winding drum, convey the reeling drum to abut the surface winding drum and, after the reeling drum has had a certain number of turns of the paper web wound onto it, deliver the reeling drum to a secondary system for continued reeling. An acceleration of the reeling drum is carried out before it is brought to abut the surface winding drum, but it is not specified how or where this takes place. A disadvantage with this reel-up is that the primary arms, which are pivoted about a fixed pivoting point, have a constant radial length and the position of the grippers on the primary arms is fixed. The primary arms thus have an invariable reach, determined by the fixed turning radius of the arms. Consequently, the primary arms can compensate only for very small variations in the "collecting position" of the new reeling drums, successively fed to the lowermost point in the drum stock. For the primary arms to be maneuverable between the drum stock and the surface winding drum, the stock must be situated beyond the turning radius. This means that the location of the drum stock becomes completely dependent on the fixed reach of the primary arms. Furthermore, primary arms with an invariable reach greatly reduce the ability to let the paper reel continue to build up in the primary system because the primary arms must deliver the reeling drum and the paper reel commenced thereon to the secondary system within a very limited space adjacent to the surface winding drum. This known construction also has a relatively large space where the primary arms are pivoted within which no other fixed installations can take place.

U.S. Pat. No. 3,877,654 discloses a reel-up with primary arms that have beams on which linearly moveable carriages are mounted. The carriages are provided with grippers for reeling drums. Each carriage is arranged to be conveyed along its beam with the aid of an actuator from a first position in which a reeling drum is gripped in a drum stock arranged above the surface winding drum, to a second position in which the reeling drum is brought into contact with the surface winding drum. The free ends of the beams are located beyond the carriages when the carriages are in the first position for collecting a reeling drum from the drum stock. Accordingly, the reel-up does not reduce the requisite working space in any appreciable way compared to the reel-ups that use lowering arms. The acceleration of the reeling drum takes place only after the reeling drum has been conveyed from the drum stock all the way to a position immediately adjacent to the surface winding drum, and therefore no tangible time savings are made, despite the elimination of the lowering arms. A further disadvantage is that roller bearings are arranged to guide the carriage along the beam, and hence it is difficult to control the position of the carriage along the beam with any great precision. This can result in unsatisfactory control of the nip pressure between the reeling drum and the surface winding drum.

SUMMARY OF THE INVENTION

The purpose of the present invention is to provide an improved reel-up that substantially reduces or eliminates the above-mentioned problems. The problem of unusable or excessive space for accommodating the pivotal movement of the lowering arms is addressed by providing a reel-up in which an empty reeling drum is lowered from a supply of empty reeling drums above a surface winding drum by a pair of primary arms that include grippers that are movable along the arms toward and away from a pivot axis of the arms. The free ends of the arms remote from the pivot axis are spaced from the empty reeling drum waiting to be collected from a "stand-by" station of the drum supply. More particularly, the free ends of the arms are located at a distance from the pivot axis of the primary arms that is less than the distance from the pivot axis to the reeling drum in the stand-by station of the drum supply. The grippers on the primary arms are movable beyond the free ends of the arms so as to reach and grip the reeling drum in the stand-by station. Accordingly, the overhead space required for accommodating the primary arms can be reduced relative to a reel-up in which the grippers are located inward of the free ends of the arms.

In accordance with a preferred embodiment of the invention, which addresses the problem of wasted time in accelerating the new reeling drum up to the speed of the traveling paper web, one of the primary arms supports a drive device that is operable to rotatably drive the retrieved reeling drum and accelerate it to the speed of the web while the reeling drum is held in the primary arms and before the reeling drum is engaged with the surface winding drum. Thus, the new reeling drum is being brought up to the requisite speed while it is being lowered to the surface winding drum. The invention thereby enables the elimination of the time delay associated with the prior practice of holding the reeling drum in a waiting position near the surface winding drum after the reeling drum has been lowered so that the reeling drum can be accelerated up to speed.

Preferably, the grippers on the primary arms comprise a pair of opposed gripping members mounted on each arm and operable to grip the coupling devices on the opposite ends of an empty reeling drum. The grippers advantageously are mounted on a carriage that is linearly movable along the arm. The grippers are relatively movable toward and away from each other for alternately gripping and releasing the coupling devices on the reeling drum. Preferably, one of the gripping members is fixed and the other is movable toward and away from the other by an actuator mounted on the carriage. The carriages are movable along the arms by actuators mounted on the arms. Advantageously, the actuators for moving the carriages comprise hydraulic cylinders.

BRIEF DESCRIPTION OF THE DRAWINGS

The invention is further explained in the following with reference to the drawings.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
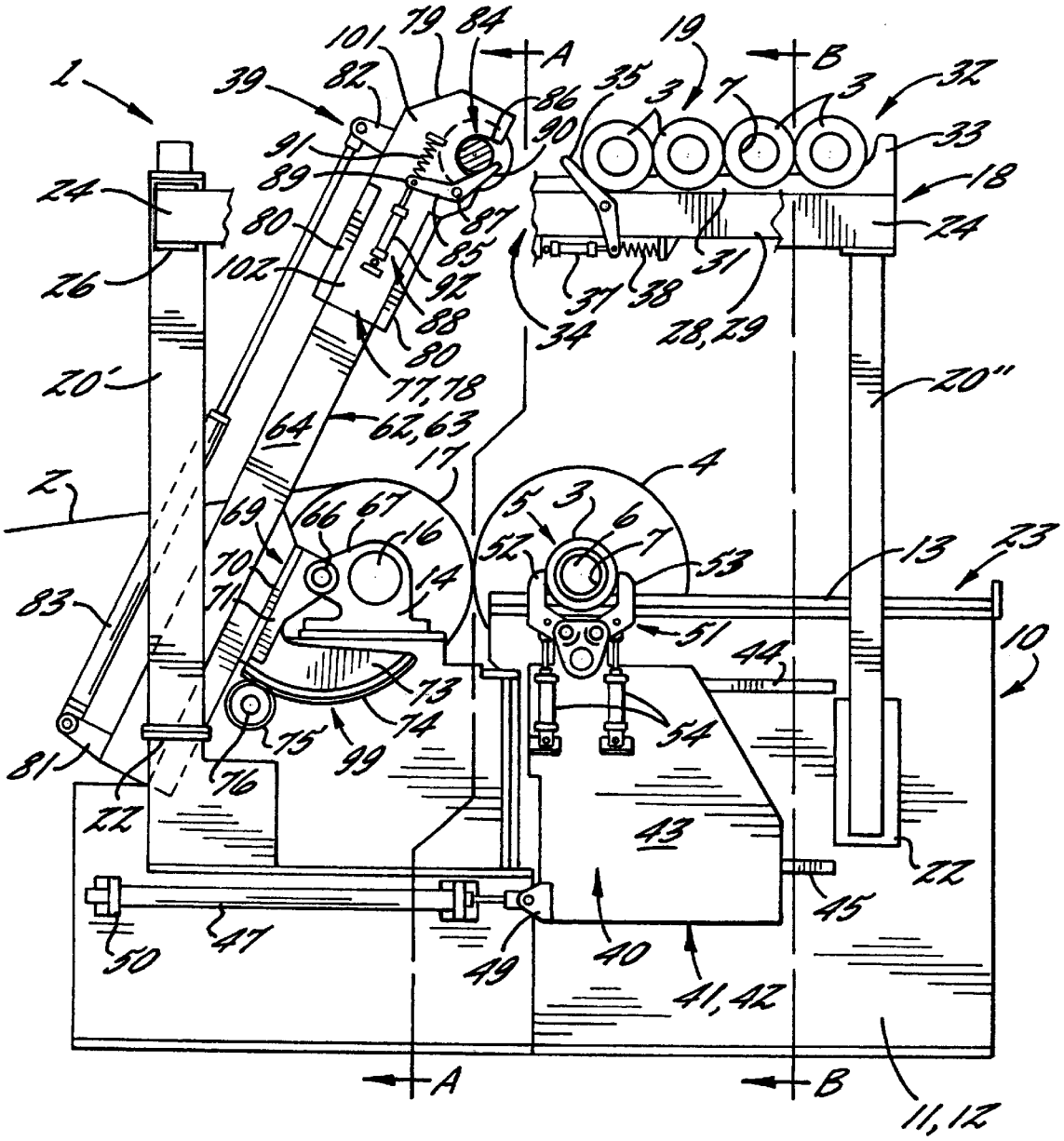
FIG. 1 is a schematic side view of parts of a reel-up with primary arms in a position in which a reeling drum is collected in a drum stock.
Figure 4:
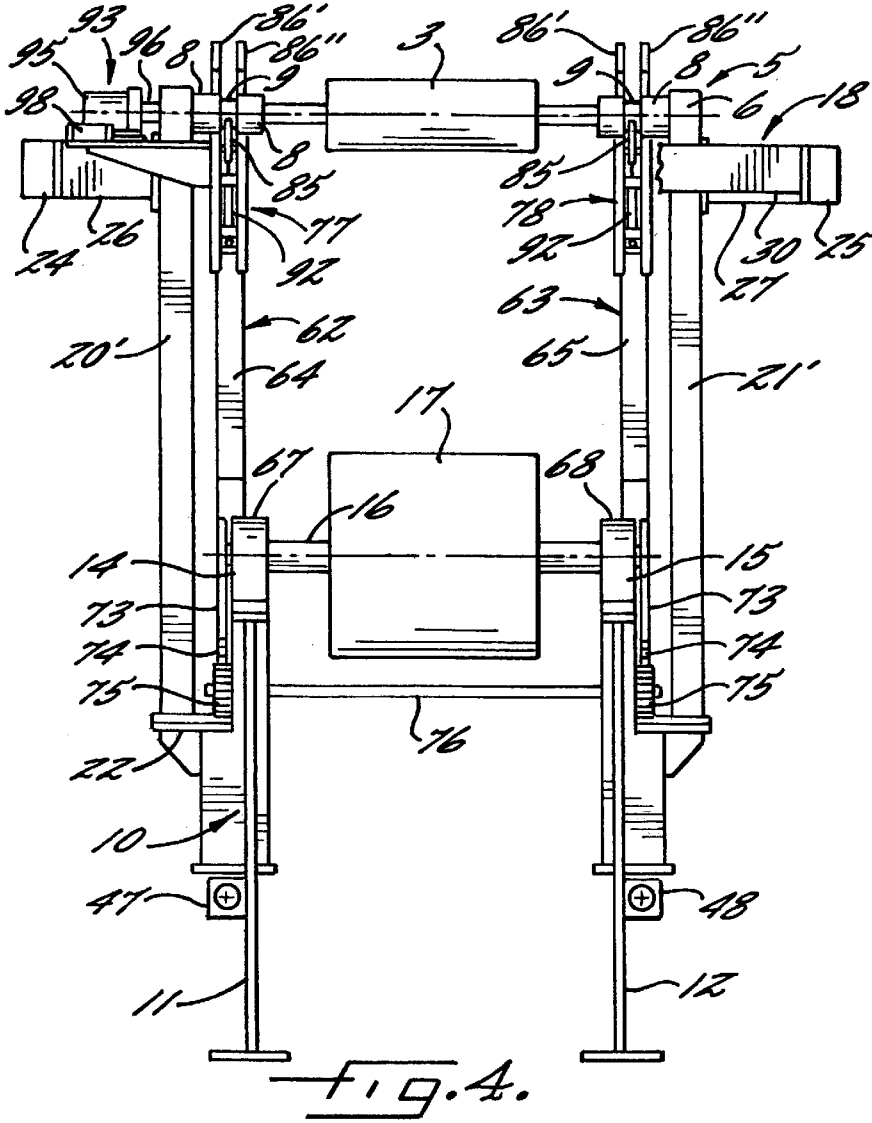
FIG. 4 is a cross section along the line A—A in FIG. 1.

FIG. 1 shows, in a schematic side view, parts of a reel-up in a paper machine, in which paper is manufactured in a continuous web 2, which is reeled in the reel-up onto a rotatable reeling drum 3 to form a paper reel 4. The reeling drum 3, see FIGS. 4 and 5, has a braking drum 5 at each end, which comprises a coupling device 6 with an internal toothed rim 7, and a bearing house 8 located on the inner side of the coupling device 6, which bearing house 8 is provided with a peripheral circumferential groove 9. The reel-up comprises a stand 10 with first and second longitudinally extending, parallel stand members 11, 12, on which the reeling drums 3 roll along horizontal first rails 13 rigidly mounted above each stand member 11, 12, by means of the peripheral grooves 9 arranged at each end of the reeling drum 3, which grooves 9 receive and cooperate with the rails 13. Between the stand members 11, 12, at the upstream end of the reel-up 1, there is a surface winding drum 17 that is rotatably journalled by means of a drive shaft 16 and two bearing houses 14, 15, over which surface winding drum 17 the paper web 2 runs. The surface winding drum 17 is driven by a motor (not shown). Above the surface winding drum 17, there is a shelf 18 for a stock 19 of reeling drums 3. A number of pillar pairs 20', 21'; 20", 21" are arranged at a distance from each other along the reel-up, which pillar pairs are arranged to support the stock shelf 18 at a certain distance above the stand 10. The pillar pairs 20', 21', 20", 21" are arranged with a first pillar 20', 20" of each pillar pair by the first stand member 11 and a second pillar 21', 21" of each pillar pair by the second stand member 12. Each pillar 20', 20", 21', 21" is rigidly mounted to the outside of its stand member 11, 12 by means of a support 22 arranged thereon and so mounted at such a distance from the outside of the stand members 11, 12 that the reeling drum 3 can be conveyed freely along the stand 10. Alternatively, the pillars can be rigidly mounted on the floor. A first pillar pair 20', 21' is located upstream of the surface winding drum 17, while a second pillar pair 20", 21" is arranged at a reel-handling station 23 at the downstream end of the reel-up 1. Two horizontal beams 24, 25 extend parallel with and each one at a distance outside one of the stand members 11, 12 respectively, which horizontal beams 24, 25 are rigidly mounted to the upper ends of the pillars 20', 20", 21', 21" via cross beams 26, 27 arranged one at each pillar 20', 20", 21', 21" (see FIG. 4). Two horizontal support elements 28, 29 extend parallel with and each one at a distance inside of one of the horizontal beams 24, 25 respectively from the downstream pillar pair 20", 21" and upstream along the greater part of the length of said beams 24, 25, which support elements 28, 29 are rigidly connected each to one of the horizontal beams 24, 25 respectively via several cross bars 30. The support elements 28, 29 are on their upper side provided with rigidly mounted second rails 31, the top surfaces of which rails 31 are arranged at such a level above the beams 24, 25 that the reeling drums 3 in the drum stock 19 can roll freely along the rails 31 in their peripheral grooves 9. The rails 31, 13 of the support elements 28, 29 and the stand members 11, 12 are situated in pairs in the same vertical planes.

The drum stock 19 has an entry 32 situated by the downstream pillar pair 20", 21", to which entry 32 a suitable transportation device (not shown) is arranged to continuously deliver empty reeling drums 3. The rails 31 of the support elements 28, 29, extend from the entry 32 of the drum stock 19 and further along each support element 28, 29, preferably along their entire length, and have a stop shoulder 33 designed as a vertical elevation at the entry 32, over which stop shoulder 33 the reeling drums 3 are lifted by the transportation device. An exit 34 is also arranged for the reeling drums 3 at the opposite ends of the rails 31, which ends are situated above the surface winding drum 17, more precisely in substantial proximity to a vertical plane along the downstream-facing envelope surface of the surface winding drum 17. In the embodiment shown, the rails 31 of the support elements 28, 29 have a certain predetermined gradient towards said exit 34, which gradient is sufficient to secure a self-acting, continuous gravity feed of the reeling drums 3 in the stock 19 in the direction from the entry 32 of the stock 19 to its exit 34. In another embodiment, not shown, a feeding device is instead arranged by the stock shelf to convey the reeling drums along the rails. At the exit 34 from the drum stock 19, a pivotably journalled and maneuverable blocking arm 35 is arranged on each rail 31 or on each support element 28, 29, which blocking arm 35 is designed in such a way that the blocking arm 35 prevents the reeling drum 3 that is situated outermost in the stock 19, relative to the feeding direction, from rolling any further. A power cylinder 37 and a spring 38 are arranged for maneuvering the blocking arm 35 from a first impeding position to a second position that lets the reeling drum 3 pass by the blocking arm 35 such that the reeling drum 3 moves into a stand-by station of the drum stock 19 from which the reeling drum 3 can be collected by the primary arms of the reel-up in a manner described below.

Further, the reel-up 1 comprises two separate reeling systems 39, 40 that cooperate with each other to provide continuous reeling of the paper web 2 on said reeling drums 3, namely a primary system 39, in which wrapping onto a new reeling drum 3 and initial reeling of the paper web 2 take place, and a secondary system 40, which receives the reeling drum 3 from said primary system 39 after a certain number, usually a small number, of turns of the paper web 2 has been reeled onto the reeling drum 3. The continued reeling of the paper reel 4 then takes place in the secondary system 40.

The secondary system 40 has a secondary unit which, in the embodiment shown, comprises two secondary carriages 41, 42, each being linearly movable along its own stand member 11, 12. In an alternative embodiment, not shown, the secondary unit instead comprises two secondary arms., each being pivotably arranged, by means of an individual actuator, on its own stand member. Each secondary carriage 41, 42 comprises at least one vertical plate element 43, which is arranged parallel with the outside of one of the stand members 11, 12 respectively. In other unillustrated embodiments, each secondary carriage instead comprises a plate element arranged solely on the inside of its associated stand member or, alternatively, there are two plate elements connected to each other and arranged both on the outside and the inside of each stand member. Between said plate element 43 and its stand member 11, 12, a number of horizontal linear bearings are arranged, which comprise an upper and a lower rail 44, 45 arranged at a distance from each other and parallel with the outside of the stand member 11, 12 and which rails 44, 45 extend from the surface winding drum 17 to the downstream end of the reel-up 1. On the inside of the plate element 43 facing the stand member 11, 12, a corresponding number of linear bearings 46, each one with a rail 44, 45, are arranged in aligned pairs for cooperation with the rails 44, 45. An actuator in the form of a power cylinder 47, 48 is arranged on the outside of each stand member 11, 12, which power cylinder 47, 48 extends from a first attachment 49 arranged on the plate element 43 of the secondary carriage 41, 42 to a second attachment 50 arranged upstream of the surface winding drum 17 on the relevant stand member 11, 12. The two power cylinders 47, 48 are arranged to move the secondary carriages 41, 42 synchronously along the stand members 11, 12. On each secondary carriage 41, 42 of the secondary unit, an additional maneuverable gripper 51 is arranged which, in the embodiment shown, is located on the outside of the plate element 43 of the secondary carriage 41, 42, which gripper 51 receives the reeling drum 3 from the primary system 39. The gripper 51 comprises at least one locking arm 52, which is arranged at the upstream side of a gripped reeling drum 3, and at least one press arm 53, which consequently is arranged at the opposite, downstream side of said reeling drum 3. In the embodiment shown in FIG. 5, a gripper 51 comprising duplicate, parallel locking and press arms is shown. The locking arm 52 and the press arm 53 are both pivotally journalled by their lower ends on said plate element 43 and are maneuverable by means of individual power cylinders 54 from an open position in which the reeling drum 3 is released, to a closed position in which the reeling drum 3 is gripped.

Figure 5:
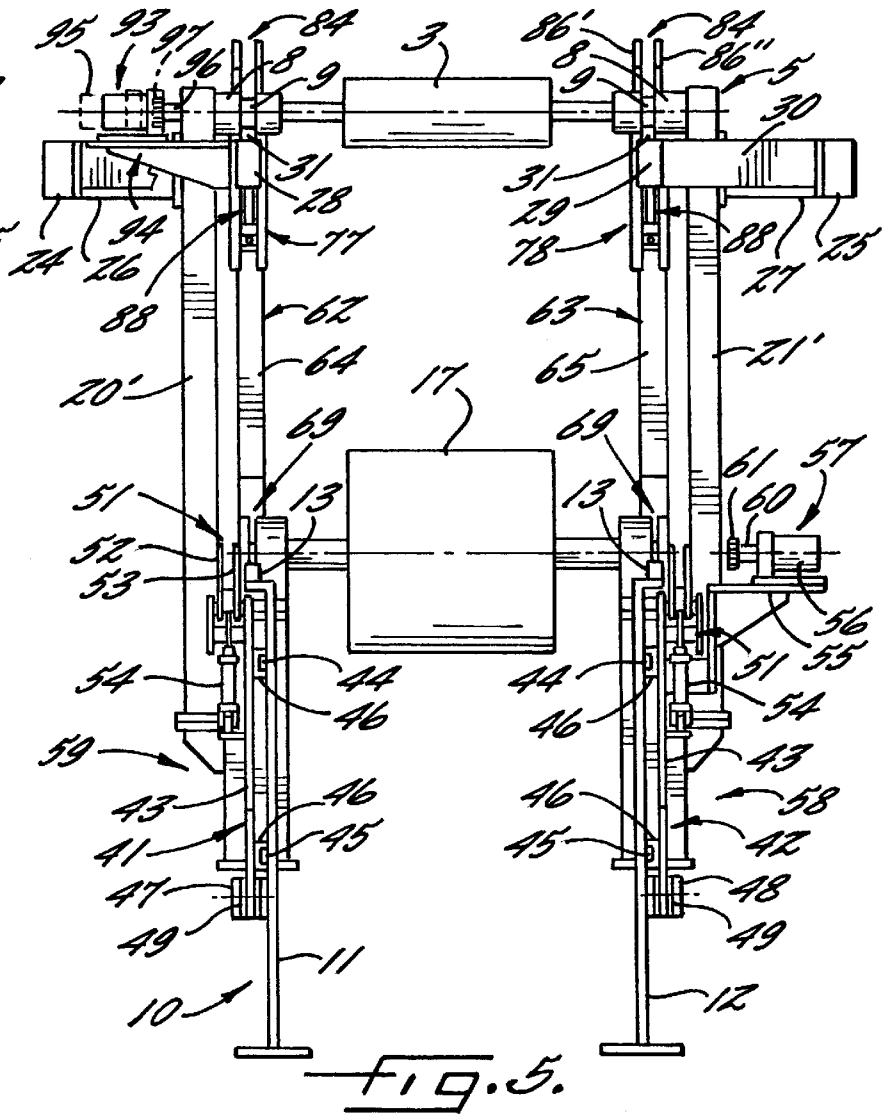
FIG. 5 is a cross section along the line B—B in FIG. 1 where the paper reel and its reeling drum have been removed.

A platform 55 is further mounted on one of the secondary carriages 41, 42, see FIG. 5, on which platform a motor 56 is arranged for the central drive of the secondary system 40, i.e., rotation of the reeling drum 3 during reeling of the paper web 2 thereon. The side of the reel-up 1 on which the central drive device 57 of the secondary system 40 is arranged is hereinafter referred to as the drive side 58, while the opposite side is referred to as the operator side 59. The motor 56 includes a rotatable shaft 60, which extends in a direction parallel with the reeling drum 3. A coupling in the form of an external toothed rim 61 is arranged on the shaft 60 at its end that faces the stand member 11, 12. The toothed rim 61 is arranged to cooperate with the corresponding internal toothed rim 7 on the coupling device 6 of the reeling drum 3. The shaft 60 is arranged to be coaxially displaced in relation to the coupling device 6 of the reeling drum 3 between an active, connected position and a passive, disconnected position.

The primary system 39 comprises two multi-functional primary arms 62, 63 arranged one at each stand member 11, 12. Each primary arm 62, 63 comprises an elongate beam 64, 65, which extends in a vertical plane that substantially coincides with the above-mentioned vertical planes in which the rails 13, 31 of the stand members 11, 12 and the support elements 28, 29 are situated in pairs (see FIG. 5). The free end 100 of each beam 64, 65 of each primary arm 62, 63, when in the position for collection of an empty reeling drum 3, is situated at a distance from the drum stock 19 in that the distance between the free end 100 and the axis of pivot 66 of the beam 64, 65 is less than the distance between the axis of pivot 66 of the beam 64, 65 and a reeling drum 3 in the stand-by station for collection. The beams 64, 65 are each pivotably journalled about separate axes of pivot 66, which axes of pivot 66 are located on each side of the surface winding drum 17, at the bearing houses 14, 15 of the surface winding drum 17, on the stand members 11, 12. The axes of pivot 66 are thus eccentrically arranged at a predetermined distance from and upstream of the axis of rotation 16 of the surface winding drum 17. The bearing houses 14, 15 of the surface winding drum 17 comprise two plate-shaped attachment lugs 67, 68, which protrude in an upstream direction from, and each in a plane coinciding with, one of the stand members 11, 12 respectively. Each attachment lug 67, 68 is, in the embodiment shown, situated at the same level as the axis of rotation 16 of the surface winding drum 17. In other alternative embodiments, not shown, the beams can be journalled in pivot bearings arranged in other locations than above in relation to the axis of rotation of the surface winding drum, including an embodiment in which the axes of pivot of the pivot bearings and the axis of rotation of the surface winding drum are coincident. Each beam 64, 65 is rigidly mounted on an attachment 69 arranged at the lower half of the beam 64, 65. The attachment 69 comprises a plate 70 attached to the side of the beam 64, 65 facing the surface winding drum 17, and a plate-shaped bracket 71, which protrudes from and perpendicularly to the plate 70 and parallel with the outside of the attachment lug 67, 68 of the bearing house 14, 15. A pivot bearing is arranged between the bracket 71 and the attachment lug 67, 68, which pivot bearing defines the above-mentioned axis of pivot 66. A further actuator 99 is arranged to pivot the beam 64, 65 about the axis of pivot 66. In the embodiment shown, this further actuator 99 comprises a disc segment 73, which is rigidly mounted on the attachment 69 and which disc segment 73 represents a circular-arc segment in the shape of a shark fin. The disc segment 73 has a truncated end affixed to the support plate 70 and is arranged, in relation to the bracket 71 and the attachment lug 67, 68, in a position axially between them (see FIG. 1). Each disc segment 73 is arranged to cooperate by means of its toothed, upstream-facing, convex edge 74 with gear drives 75, which gear drives 75 are rigidly mounted on the outer ends of a synchronization shaft 76 that extends parallel with the surface winding drum 17 and which shaft 76 is rotatably journalled to each stand member 11, 12. The shaft 76 and gear drives 75 are rotatably driven by a suitable drive device (not shown), such as an electric motor or the like.

Figure 2:
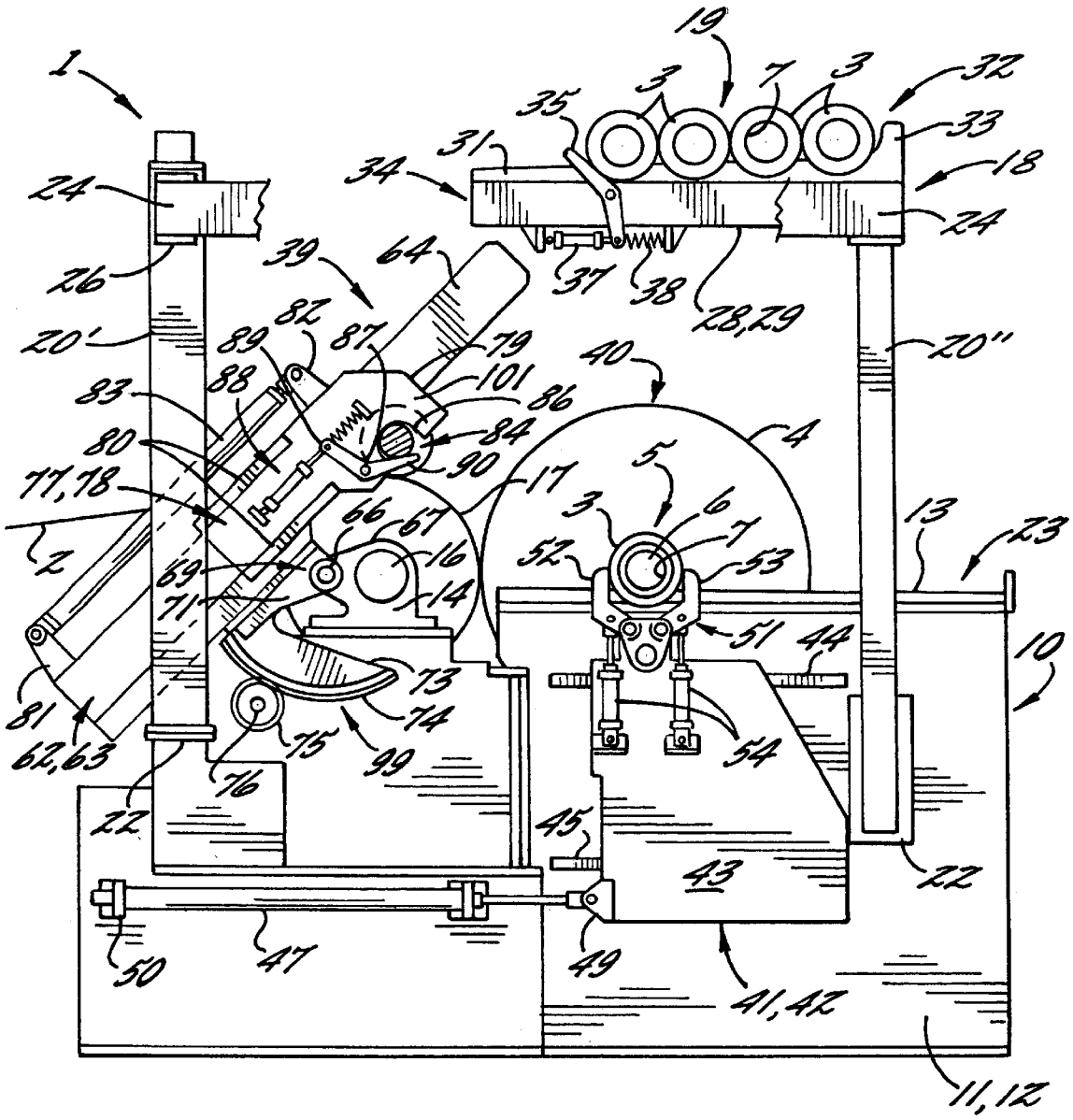
FIG. 2 shows the reel-up in accordance with FIG. 1 with the primary arms in a position in which the reeling drum is brought to abut a surface winding drum.

Each primary arm further comprises a carriage 77, 78 that is arranged for movement along the beam 64, 65. The carriage 77, 78 comprises an elongate, axially open, sleeve-shaped body 79 with rectangular cross section, which body 79 is arranged on the outside of and at least partially surrounding the beam 64, 65. The beam 64, 65 and the carriage 77, 78 are designed in such a way, relative to each other, that an interspace requisite for the movement is formed between them. In the interspace, several bearings 80 are arranged on the inside of the carriage 77, 78 facing the beam 64, 65. Said bearings 80 may, for instance, constitute slide, roller or linear bearings. In the embodiment shown, see FIG. 1, the bearings 80 are constituted by linear bearings that are arranged in said interspace on the upper and lower sides of the beam 64, 65. In other embodiments, not shown, the bearings may, of course, be arranged differently, for instance, solely on the side of the beam 64, 65 facing away from the surface winding drum 17, i.e. the top side of the beam 64, 65; on the vertical sides of the beam 64, 65; or on other suitable combinations of said sides. The carriage 77, 78 or, more precisely, its elongate body 79, has an outer part 101 and an inner part 102, with which the carriage 77, 78 is displaceably journalled on the beam 64, 65. A first attachment 81 is mounted on the top side of the beam 64, 65 in the proximity of its upstream end. A second attachment 82 is arranged on the top side of the carriage 77, 78 at its other end. A power cylinder 83 is arranged to extend between said first and second attachments 81, 82, by means of which power cylinder 83 the carriage 77, 78 is arranged to be moved along the beam 64, 65 between a retracted, inner position (see FIG. 2) and an outer position, partially protruding beyond the downstream end of the beam 64, 65 (see FIG. 1). The total length of the primary arm 62, 63, when the carriage 77, 78 is at its outermost, protruding position, i.e. the combined axial length of both the span of the beam 64, 65 and the span of the outer part 101 of the carriage 77, 78 that protrudes beyond it, is thus considerably greater than the relevant length of the primary arm 62, 63 when the carriage 77, 78 is in its retracted, inner position, i.e. the length of the beam 64., 65 alone.

Figure 3:
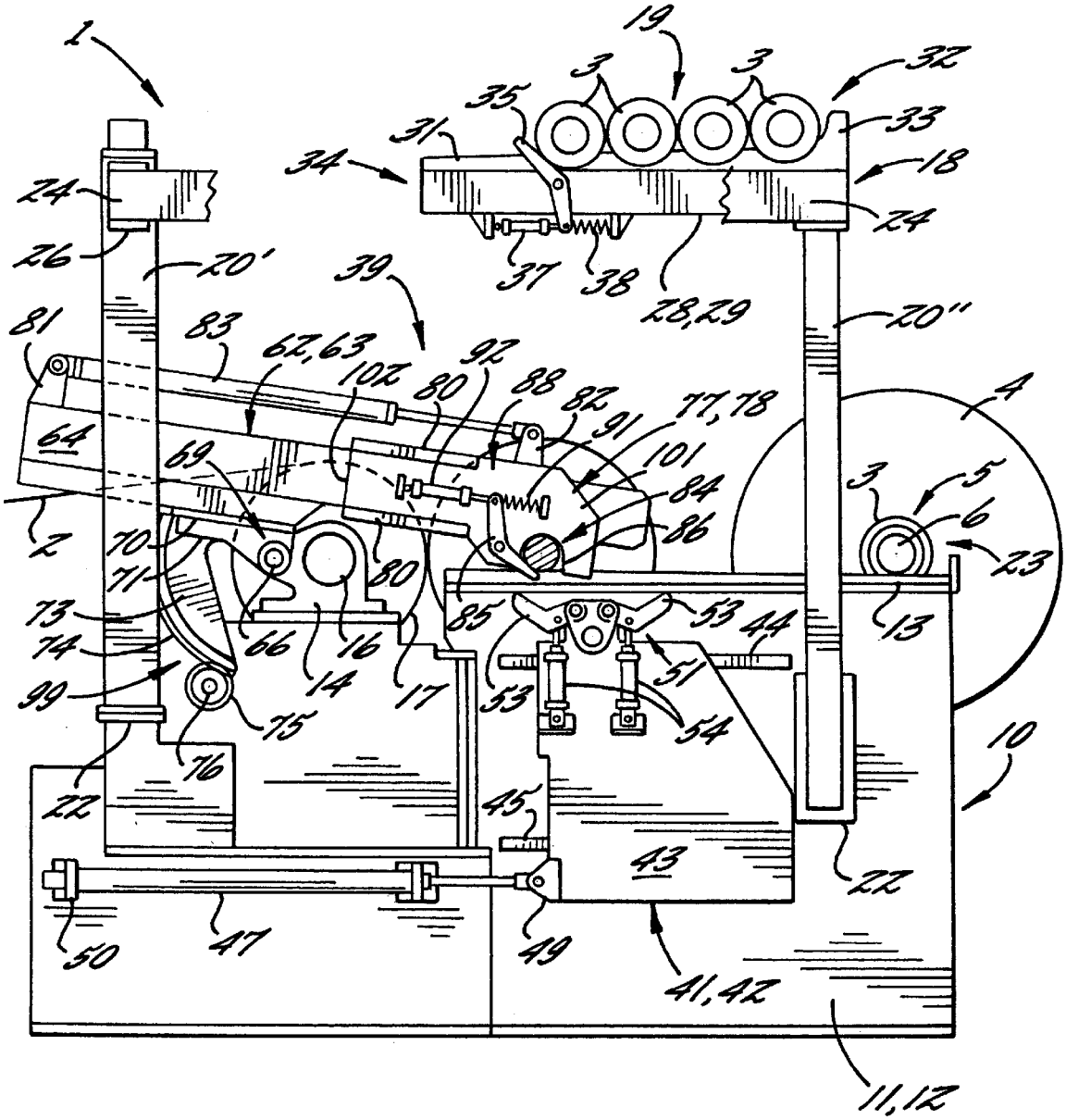
FIG. 3 shows the reel-up in accordance with FIG. 1 with the primary arms in a position in which the reeling drum is delivered to a secondary system.

A gripper 84 is arranged on the underside of the carriage 77, 78, i.e. on the side facing the surface winding drum 17, which gripper 84 comprises at least two opposed, first and second gripping members 85, 86, of which at least one gripping member 85 is movably arranged. The other gripping member 86 may suitably constitute a recess in the body 79 of the carriage 77, 78, as in the embodiment of the gripper 84 schematically shown in the drawings (see FIGS. 1–3), which recess 86 thus constitutes a counter support for the movable gripping member 85. The recess 86 forms two parallel, fixed gripping members 86', 86", see FIGS. 4 and 5, in the two vertical sides of the body 79. Between said gripping members 86', 86", the movable inner gripping member 85 is pivotably arranged about a pivot bearing 87 by means of an actuator 88. The opposite gripping members 85, 86 are also arranged and designed in such way that together they form between themselves a substantially circular space with an area that corresponds to the cross section of the reeling drum 3 at the peripheral groove 9. The movable gripping member 85, which is shown merely schematically in FIGS. 1–3, comprises a lever 89 on its inner side in relation to the pivot bearing 87 and an outer gripping member 90 that is arranged to abut said groove 9 in the peripheral surface of the gripped reeling drum 3. The actuator 88 comprises a spring 91 and a power cylinder 92 arranged adjacent to the lever 89 in such a way that the gripper 84 is opened by activation of the power cylinder 92, the spring 91 then being tensioned. The tensioned spring 91 is, consequently, arranged to automatically close the gripper 84 if or when the power cylinder 92 is deactivated, irrespective of whether or not this is intentional, whereby the transfer of new reeling drums 3 from the drum stock 19 and further to the secondary system 40 thus becomes completely safe and reliable. In other embodiments, not shown, the gripper may also comprise several movable gripping members, out of which at least two, in that case, are opposite and arranged to cooperate with each other by means of individual actuators. One or more of the movable gripping members may also constitute a gripping member that can be axially shifted along the carriage and said fixed gripping member may constitute an arm (not shown) that is rigidly arranged on the carriage and protruding from the body thereof.

On the primary arm 62 that is situated on the opposite side of the reel-up in relation to the central drive device 57 of the secondary system 40, i.e. on the operator side 59 of the reel-up shown in FIG. 5, there is a central drive device 93, also referred to as a starting device or reel starter. The central drive device 93 is operable to accelerate each reeling drum 3 gripped from the drum stock 19 to the peripheral speed of the web 2 passing over the surface winding drum 17. This central drive device 93 is mounted on a platform 94, which is secured to the outside of one of the primary carriages 77, i.e. on its side facing away from the stand member 11, 12. The motor 95 of the central drive device 93 includes a rotatable shaft 96 that is parallel with a gripped reeling drum 3 and protrudes from the motor 95 towards the bearing house 8 of the reeling drum 3. A coupling device in the shape of an external toothed rim 97 is, in the same way as with the central drive device 57 of the secondary system 40, arranged outermost on the shaft 96. The external toothed rim 97 is arranged to cooperate with the corresponding internal toothed rim 7 of the reeling drum 3 in the lowermost position in the drum stock 19. The rotatable shaft 96 of the central drive device 93 is arranged to be moved from a retracted, passive position (shown by broken lines in FIG. 5), in which the primary central drive device 93 is disconnected, to a protruding, active position (shown by unbroken lines in FIG. 5) by means of a power cylinder 98, in which active position the primary central drive is connected and the corresponding coupling devices 6, 97 are in cooperation with each other.

The reel-up is further provided with a control unit (not shown), which has several control devices, not shown, such as angle transducers, photocells and the like, which are arranged at several positions in the reel-up 1 in order to sense the position of each reeling drum 3 during its progress through the reel-up 1, which control devices are also arranged in order to sense and control the primary system 39, for instance the positioning and functioning of the primary arms 62, 63, the carriages 77, 78 and the grippers 84, including the connection and disconnection of the primary central drive device 93.

The described reel-up operates in the following way. After the commenced paper reel 4, held by the primary arms 62, 63, has been delivered to the secondary system 40 of the reel-up 1 for continued reeling to produce a finished paper reel 4, the beams 64, 65 of the primary arms 62, 63 are pivoted synchronously from the substantially horizontal position, in which the reeling drum 3 is delivered to the secondary system 40 at the downstream side of the surface winding drum 17 (see FIG. 3), anti-clockwise upwardly/rearwards to the rear collecting position of the primary arms 62, 63, directed diagonally upwards (see FIG. 1), in which a new reeling drum 3 is collected from the drum stock 19. The synchronous pivoting of the primary arms 62, 63 is performed with the assistance of the synchronization shaft 76 arranged between the stand members 11, 12 parallel with the surface winding drum 17, and which is maneuvered by an actuator (a motor, for instance), not shown. During said manipulation, the gear drives 75 arranged at both ends of the synchronization shaft 76 cooperate with the disc segments 73 of the primary arms 62, 63, whereby the desired change of angle for the primary arms 62, 63 is obtained synchronously in both primary arms 62, 63, while suitably located control devices (not shown), angle transducers, for instance, continuously sense and control the movements of the primary arms. Thereafter, or while said pivoting is in progress, when the primary arms 62, 63 are at a suitable angle in relation to other installations, the carriages 77, 78 are moved, by means of the power cylinder 83 of each carriage 77, 78, axially outward along the beams 64, 65. The angle movement of the beam 64, 65 and the linear movement of the carriage 77, 78 are suitably coordinated in such a way so that, when the beam 64, 65 assumes the angle determined for the desired collecting position, the carriage 77, 78 simultaneously arrives at the axial position along the beam 64, 65 determined for the gripping of a new reeling drum 3. The gripper 84 on the primary arm 62, 63 is thereafter activated, when the gripper 84 is thus in its correct position for collection, level with the outermost reeling drum 3 in the lowermost position of the drum stock 19, whereupon the gripper 84 is opened. A new reeling drum 3 is allowed to roll along the rails 31 of the drum stock 19 into the open grippers 84, by the blocking arm 35 of the drum stock 19 being moved from its impeding position to its position that allows the reeling drum 3 to pass. The grippers 84 on the primary arms 62, 63 are thereafter closed, whereupon the movable gripping member 85 is brought into co-operation with the peripheral groove 9 of the reeling drum 3, whereby the reeling drum 3 is gripped in a completely safe manner. The coupling device 97 of the central drive device 93 of the primary system 39 is then moved to its active position into engagement with the coupling device 6 of the reeling drum 3, whereafter the reeling drum 3 is lifted a short distance by a further small, anti-clockwise pivoting movement of the beams 64, 65, or by a further small, axial displacement outwards of the carriages 77, 78, in the manner described above, so that the reeling drum 3 is lifted above the rails 31 of the drum stock 19. The central drive device 93 of the primary system 39 thereafter starts the rotation of the gripped reeling drum 3, which is accelerated from stand-still up to its full rotation speed, which corresponds with the speed of travel of the web 2 running over the surface winding drum 17, which full rotation speed is achieved already during the preferably continuous transfer down to the surface winding drum 17.

The lowering of the gripped reeling drum 3 is preferably commenced already at the beginning of the acceleration, which lowering is performed by way of a movement of the carriages 77, 78 along the beams 64, 65, a clockwise pivoting movement of said beams 64, 65, or both these movements performed in conjunction with each other and in accordance with a predetermined manner.

In summary, the multi-functional primary system 39 grips a new reeling drum 3 in the drum stock 19 with the gripper 84 in its outer gripping position, moves the drum 3 in a continuous movement downwards into contact with the surface winding drum 17, whereafter the primary arms 62, 63, by way of the actuators 83, convey the reeling drum 3 down along the periphery of the surface winding drum 17, while a predetermined nip pressure between the commenced paper reel 4 and the surface winding drum 17 is applied to the paper reel 4 in formation. The applied nip pressure is regulated by means of control devices comprising suitable transducers, not shown, which control devices control said actuator 83. In the wrapping position, the primary arms 62, 63 have moved the reeling drum 3, which by then has reached full rotation speed, down into contact with the surface winding drum 17, whereupon wrapping takes place, i.e. the paper web 2 carried along is caused to commence reeling onto the empty reeling drum 3. The finished paper reel 4, held by the secondary system, is simultaneously conveyed downstream by the secondary carriages 77, 78 towards the reel-handling station 23 of the reel-up 1.

Two advantages are gained by thus constructing each primary arm 62, 63 with two longitudinally extending parts that are axially displaceable in relation to each other, i.e. the beam 64, 65 and the carriage 77, 78, which parts in addition are movable beyond each other. First, the total reach of the primary arm 62, 63 is increased, the span being almost doubled in the embodiment shown. Second, and at the same time, the length of the primary arm 62, 63 with its carriage in the retracted position is much shorter than can be achieved with the corresponding, smallest possible length of the primary arm in all other hitherto known reel-ups with the same maximum outer reach for gripping a new reeling drum.

It will be appreciated that the design and shape of the beam 64, 65 of the primary arm 62, 63 in principle can have any desired cross-sectional shape. The beam 64, 65 may thus be solid, comprise two or more substantially parallel beam elements, or consist of tubular part elements that are displaced telescopically in relation to each other. The specific actuators included in the present invention may, likewise, comprise various types such as pneumatic, hydraulic, electrical or mechanical actuators. The toothed disc segment 73 and the gear drive 75 that cooperates with it may, in an alternative embodiment, not shown, instead comprise a link-arm system comprising several link arms that are pivotably arranged in relation to each other, which link-arm system is functionally arranged between the synchronization shaft and the beams of the primary arms so that a simultaneous pivoting movement of equal magnitude is secured in both the primary arms by the pivoting of the synchronization shaft in this embodiment as well. Instead of having a mechanical coupling between the primary arms, the position may be controlled with the aid of, for instance, angle transducers arranged on both primary arms, in which case the angle is gauged on the operating side and the same angle must be secured on the drive side. Such a construction is advantageous for reasons of space. A suitable number of above-mentioned link arms may also, if so desired, be replaced by power cylinders. The bracket 71 and the disc segment 73 may also be designed as parts of a single plate-shaped element, see FIG. 4. In the illustrated embodiments of the multi-functional primary system 39, the rigidly mounted construction details included in the primary arms 62, 63 are welded thereon, but any other suitable mounting method, such as bolt or screw joints, for instance, of course lies within the scope of the invention.

Many other modifications and embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A reel-up for winding a traveling web of paper onto reeling drums to form paper reels, coupling devices being mounted on opposite ends of each reeling drum, the reel-up comprising:

a surface winding drum that rotates about an axis such that the traveling web is carried along an outer envelope surface of the winding drum;

a drum supply arranged to support one to a plurality of empty reeling drums vertically above the envelope surface of the winding drum, the drum supply defining a stand-by station from which an empty reeling drum is retrieved to have paper wound thereon;

a secondary system operable to support and rotatably drive a reeling drum in a reeling position adjacent the winding drum such that the web carried along the winding drum is wound onto the reeling drum to form a reel of paper; and a primary system operable to retrieve an empty reeling drum from the stand-by station of the drum supply and lower the empty reeling drum into engagement with the winding drum to allow the web to begin winding onto the empty reeling drum as the winding of the reel of paper held in the secondary system is being completed, the primary system comprising a pair of primary arms respectively mounted for pivotal movement in a pair of spaced parallel vertical planes generally aligned with the coupling devices on the opposite ends of the empty reeling drum, each primary arm being pivotable about a pivot axis and having a free end spaced from the pivot axis by a lesser distance than that from the pivot axis to the reeling drum in the stand-by station, each primary arm including a gripper movable along the arm generally toward and away from the pivot axis of the arm and operable to grip the coupling device on the end of the empty reeling drum proximate the arm, the grippers being movable outwardly along the arms into a collection position in which the grippers are extended beyond the free ends of the arms to enable the grippers to grip the coupling devices of the reeling drum for retrieving the reeling drum from the drum supply, the primary arms then being pivotable downwardly and the grippers being movable inwardly along the arms to carry the reeling drum to a winding position engaging the winding drum so that the web begins winding onto the reeling drum in the primary arms.

2. The reel-up of claim 1, further comprising a drive device mounted on one of the primary arms and operable to engage the coupling device of the empty reeling drum held in the primary arms and to rotatably drive the empty reeling drum so as to give the reeling drum a peripheral speed substantially equal to the speed of the traveling web prior to the reeling drum being engaged with the winding drum.

3. The reel-up of claim 2, wherein the grippers are mounted on carriages that are linearly movable along the primary arms toward and away from the pivot axes of the arms, and wherein the drive device is mounted on one of the carriages.

4. The reel-up of claim 3, further comprising a linear actuator mounted on each primary arm for moving the carriage.

5. The reel-up of claim 1, wherein the primary arms are pivotably moved in synchronization with each other by a common drive element that engages both primary arms.

6. The reel-up claim claim 5, wherein the common drive element comprises a drive shaft on opposite ends of which are mounted a pair of drive gears that engage gear elements on the primary arms.

7. The reel-up of claim 6, wherein the gear elements on the primary arms comprise circular-arc disc segments having teeth thereon and being rigidly affixed to the primary arms, the drive gears meshingly engaging the disc segments for pivotally moving the primary arms.

8. The reel-up of claim 1, wherein each gripper includes a pair of opposed gripping members at least one of which is movable toward and away from the other for alternately gripping and releasing the coupling device of the reeling drum.

9. The reel-up of claim 8, wherein the gripping members are mounted on a carriage that is movable along the primary arm, and wherein the movable gripping member is movably mounted on the carriage.

10. The reel-up of claim 9, wherein the movable gripping member is pivotally mounted on the carriage.

11. The reel-up of claim 9, further comprising a spring device coupled with each movable gripping member and operable to continuously bias the movable gripping member toward the other gripping member so as to grip the coupling device of the reeling drum, and an actuator coupled with the movable gripping member and operable to move the movable gripping member away from the other gripping member against the force of the spring device so as to release the grip on the coupling device.

12. The reel-up of claim 1, wherein the pivot axis of the primary arms is spaced from the axis about which the winding drum rotates.

13. A method for reeling a traveling web onto a reeling drum to form a paper reel, comprising:

pivoting a pair of parallel spaced arms about a pivot axis proximate a first end of each arm so as to raise an opposite second end of each arm until the second ends of the arms are proximate a drum supply containing at least one empty reeling drum;

moving a gripper along each arm in a direction away from the pivot axis such that the gripper extends upward beyond the second end of the arm, and gripping opposite end portions of the empty reeling drum in the grippers;

pivoting the arms so as to remove the empty reeling drum gripped in the grippers from the drum supply;

pivoting the arms so as to lower the second ends of the arms toward a rotating winding drum, and moving the grippers inwardly along the arms toward the first ends thereof, so as to bring the empty reeling drum into engagement with the winding drum; and carrying the traveling web along the winding drum such that the web is wound onto the reeling drum held in the arms.

14. The method of claim 13, further comprising engaging the empty reeling drum with a drive device mounted on one of the arms so as to rotatably drive the empty reeling drum held in the arms to give the reeling drum a peripheral speed equal to the speed of the traveling web prior to bringing the reeling drum into engagement with the winding drum.

15. The method of claim 13, wherein moving the grippers comprises linearly moving a carriage along each arm, the grippers being supported on the carriages.

16. The method of claim 15, wherein gripping the end portions of the empty reeling drum comprises receiving each end portion between a pair of spaced-apart and opposed gripping members supported on the respective carriage, and moving the gripping members relatively toward each other to grip the end portion of the reeling drum.

17. The method of claim 16, wherein the end portion of the reeling drum is gripped between a fixed gripping member and a pivotally movable gripping member.

18. The method of claim 13, further comprising transferring the reeling drum from the primary arms to a secondary system while reeling the web onto the reeling drum.

19. The method of claim 13, wherein the arms are pivoted about the pivot axis which is spaced from and parallel to the axis about which the winding drum rotates.

20. The method of claim 13, wherein the arms are pivoted about the pivot axis which is coaxial with the axis about which the winding drum rotates.

* * * * *